US008978934B2

(12) United States Patent
Levesley

(10) Patent No.: US 8,978,934 B2
(45) Date of Patent: Mar. 17, 2015

(54) DISPENSER FOR VISCOUS MATERIALS

(75) Inventor: Simon Levesley, Lichfield (GB)

(73) Assignee: Twistub Limited, West Midlands (GB)

( * ) Notice: Subject to any disclaimer, the term of this patent is extended or adjusted under 35 U.S.C. 154(b) by 61 days.

(21) Appl. No.: 13/388,790

(22) PCT Filed: Jul. 30, 2010

(86) PCT No.: PCT/GB2010/001446

§ 371 (c)(1),
(2), (4) Date: Feb. 3, 2012

(87) PCT Pub. No.: WO2011/015809

PCT Pub. Date: Feb. 10, 2011

(65) Prior Publication Data

US 2012/0125952 A1 May 24, 2012

(30) Foreign Application Priority Data

Aug. 5, 2009 (GB) ..... 0913624.3

(51) Int. Cl.

| | |
|---|---|
| ***A45D 34/00*** | (2006.01) |
| ***B65D 83/00*** | (2006.01) |
| ***A45D 34/04*** | (2006.01) |

(52) U.S. Cl.

CPC ..... *B65D 83/0027* (2013.01); *A45D 34/04* (2013.01); *A45D 2200/055* (2013.01)

USPC ..... 222/390; 222/386; 222/340; 222/336; 401/173; 401/174

(58) Field of Classification Search

USPC ..... 222/390, 391, 109, 108, 340, 341, 386, 222/336; 401/172–174

See application file for complete search history.

(56) References Cited

U.S. PATENT DOCUMENTS

| | | | | |
|---|---|---|---|---|
| 2,626,730 | A * | 1/1953 | Gabler | 222/326 |
| 2,627,365 | A | 2/1953 | Gabler | |
| 3,756,730 | A | 9/1973 | Spatz | |
| 3,789,857 | A * | 2/1974 | Ikeda et al. | 401/69 |
| 4,139,127 | A | 2/1979 | Gentile | |

(Continued)

FOREIGN PATENT DOCUMENTS

| | | | |
|---|---|---|---|
| EP | 0 350 661 | A2 | 1/1990 |
| WO | WO 03/066475 | A1 | 8/2003 |
| WO | WO 2004/024592 | A1 | 3/2004 |

OTHER PUBLICATIONS

International Search Report (PCT/ISA/210) issued on May 31, 2011, by European Patent Office as the International Searching Authority for International Application No. PCT/GB2010/001446.

(Continued)

*Primary Examiner* — Kevin P Shaver
*Assistant Examiner* — Nicholas J Weiss
(74) *Attorney, Agent, or Firm* — Buchanan Ingersoll & Rooney PC

(57) ABSTRACT

A dispenser for dispensing a viscous fluid stored directly within the body of the dispenser, or within a cartridge inserted within the dispenser in which the viscous fluid is forced through a dispensing aperture by advancing a piston member and where the piston is advanced by turning a first thread member that locates in the female thread of a main body member and where upon completion of such turning resilient means are provided to partly reverse the direction in which the first thread member was turned and so avoid unwanted flow of fluid following completion of such turning.

16 Claims, 8 Drawing Sheets

(56) References Cited

U.S. PATENT DOCUMENTS

| | | | | |
|---|---|---|---|---|
| 5,000,356 | A | 3/1991 | Johnson et al. | |
| 6,086,276 | A * | 7/2000 | Gueret | 401/54 |
| 6,398,439 | B1 * | 6/2002 | Szekely | 401/79 |
| 6,918,511 | B1 | 7/2005 | Spatz et al. | |
| 7,467,734 | B2 * | 12/2008 | Bocola | 222/390 |
| 2005/0242127 | A1 | 11/2005 | Bougamont et al. | |

OTHER PUBLICATIONS

Search Report issued on Nov. 18, 2009, by British Patent Office for Application No. 0913624.3.

* cited by examiner

DISPENSER FOR VISCOUS MATERIALS

TECHNICAL FIELD

The present invention relates to an improved dispenser for viscous materials such as cosmetic and medicament creams.

BACKGROUND ART

Dispensers are known where such viscous materials are dispensed by means of a piston that forms the base of a cylindrical container and that in use is advanced so that it exerts pressure upon fluid stored in a cylinder and so discharges the fluid through an aperture or nozzle. However such dispensers suffer the disadvantage that they continue to dispense fluid for a short time after the user ceases to activate the device. This results in wastage of the material being dispensed; a particular problem when the material is an expensive cosmetic or medicament.

DISCLOSLURE OF THE INVENTION

One aim of the present invention is to provide a dispenser that avoids such wastage of material. Another aim is to provide an improved dispenser.

In one aspect the invention comprises a dispenser for dispensing a viscous fluid stored directly within the body of the dispenser or within a cartridge inserted within the dispenser where the dispenser has an upper outer portion and in which the viscous fluid is forced through a dispensing aperture by advancing a piston member towards the upper outer portion and where the piston is advanced by turning a first thread member that locates in the female thread of a main body member and where upon completion of such turning resilient means are provided to slightly increase the distance between the outer portion and the piston member, in order to prevent unwanted dispensing of fluid.

In another aspect the invention comprises a dispenser for dispensing a viscous fluid stored directly within the body of the dispenser, or within a cartridge inserted within the dispenser in which the viscous fluid is forced through a dispensing aperture by advancing a piston member and where the piston is advanced by turning a first thread member that locates in the female thread of a main body member and where upon completion of such turning resilient means are provided to partly reverse the direction in which the first thread member was turned.

Preferably, the first thread member is a male thread on the outside of the piston member. Alternatively, it may be a separate member such that when it is turned it advances along the thread of a main body and pushes the piston.

Preferably, the resilient means comprises a spring or other resilient member that is either stretched or compressed during turning of the first thread member and which upon completion of such turning by a user returns to its normal length and thereby exerts a force that provides said part reversal in the direction in which the first thread member was turned. The resilient means may further comprise a second thread member with a male thread that also locates in the female thread of the main body member and wherein a spring or another resilient member provides bias between the first thread member and the second thread member. Preferably, in use the second thread member is prevented from reverse turning under the influence of the resilient member owing to the presence of a ratchet mechanism or because the male thread of the second thread member is a sufficiently tight fit within the main body member. Preferably, the first thread member or piston has an abutment member with locating means and the second thread member has a similar abutment member and locating means and wherein the ends of a spring engage said locating means.

The first thread member may be turned by a knob directly or indirectly coupled thereto and the knob may comprise a lower portion of the dispenser. The lower portion of the dispenser may be coupled to the piston by means of a split vane attached to the lower portion of the dispenser. For example, the lower portion of the dispenser may be coupled to the piston by means of a member attached to the piston that is held within a member or members attached to the lower portion of the dispenser.

The resilient means may comprise a thread or a plurality of guide tracks arranged circumferentially on the outside surface of the main body member that engage either a thread or guide members located within or upon a generally tubular side wall and a resilient member that provides bias between the body member and the tubular side wall.

The resilient means may also comprise a thread upon an upper outer portion of the dispenser that engages a thread located within or upon a generally tubular side wall and a resilient member that provides bias between the upper outer portion and the tubular side wall.

BRIEF DESCRIPTION OF THE DRAWINGS

The invention is described by reference to the following diagrammatic drawings in which.

BEST MODES FOR CARRYING OUT THE INVENTION

Figure 1:
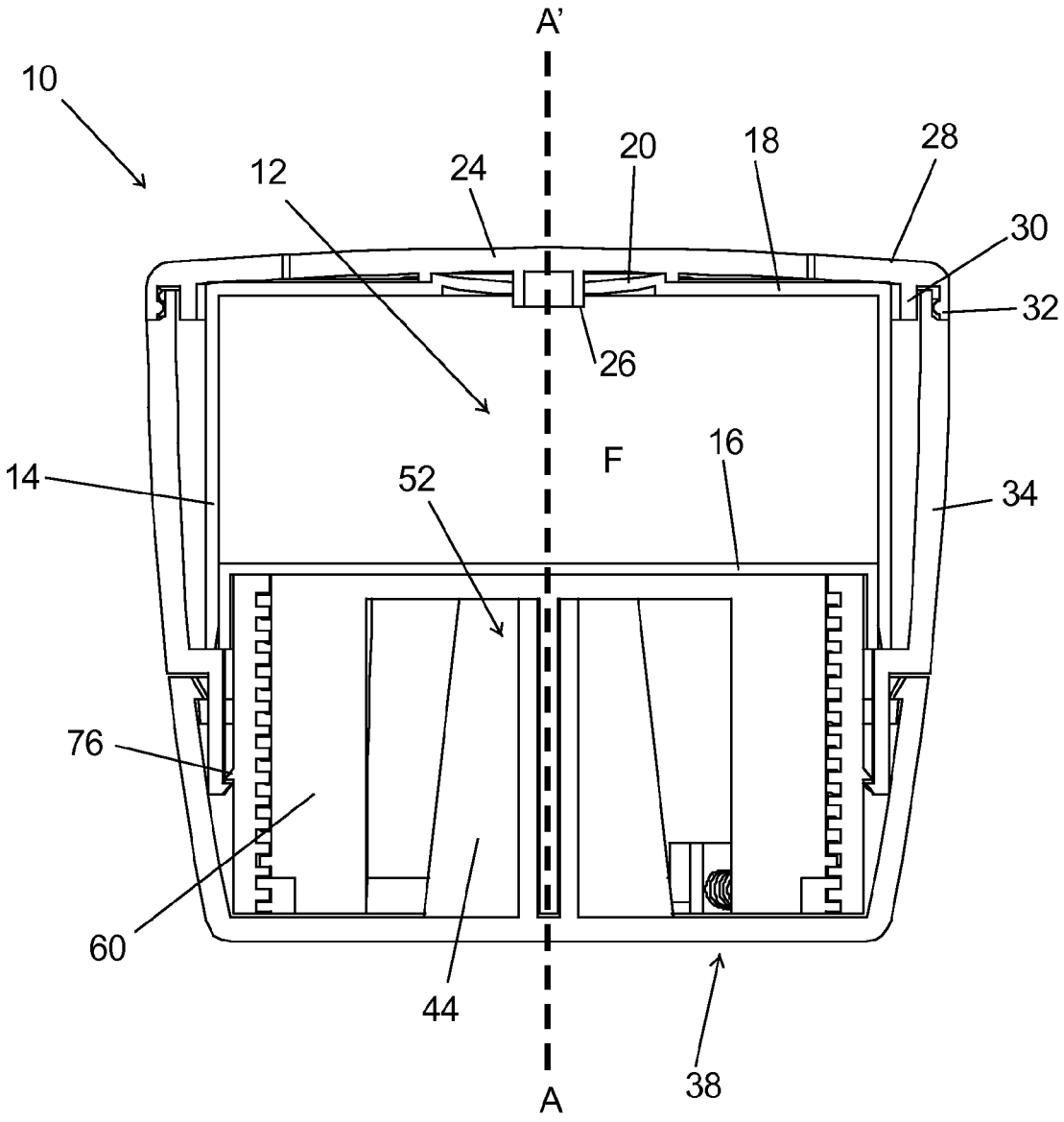
FIG. 1 is a sectioned side view of the dispenser and a fully charged disposable cartridge containing a cosmetic cream.
Figure 2:
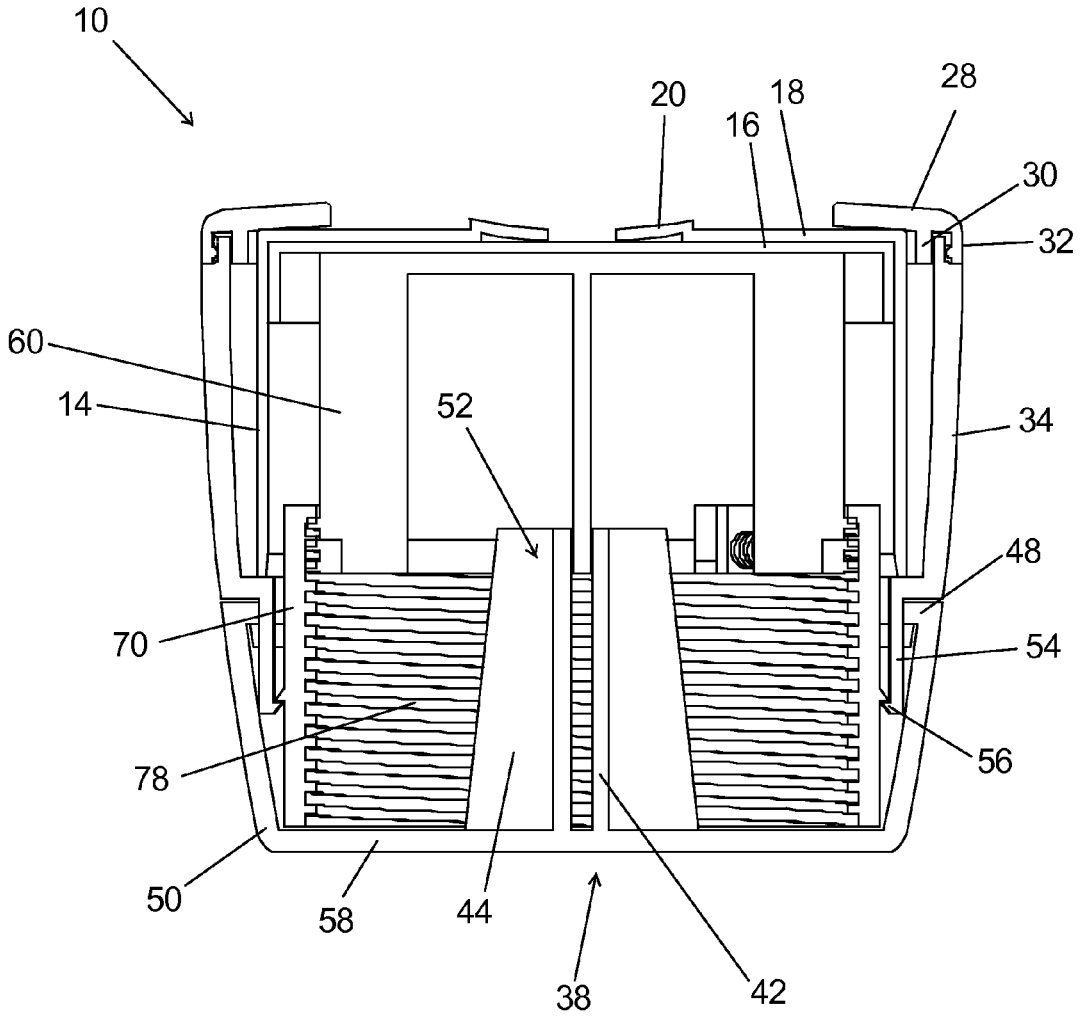
FIG. 2 corresponds to FIG. 1 but shows the dispenser in a position where the disposable cartridge has been emptied and the lid has been removed.
Figure 3:
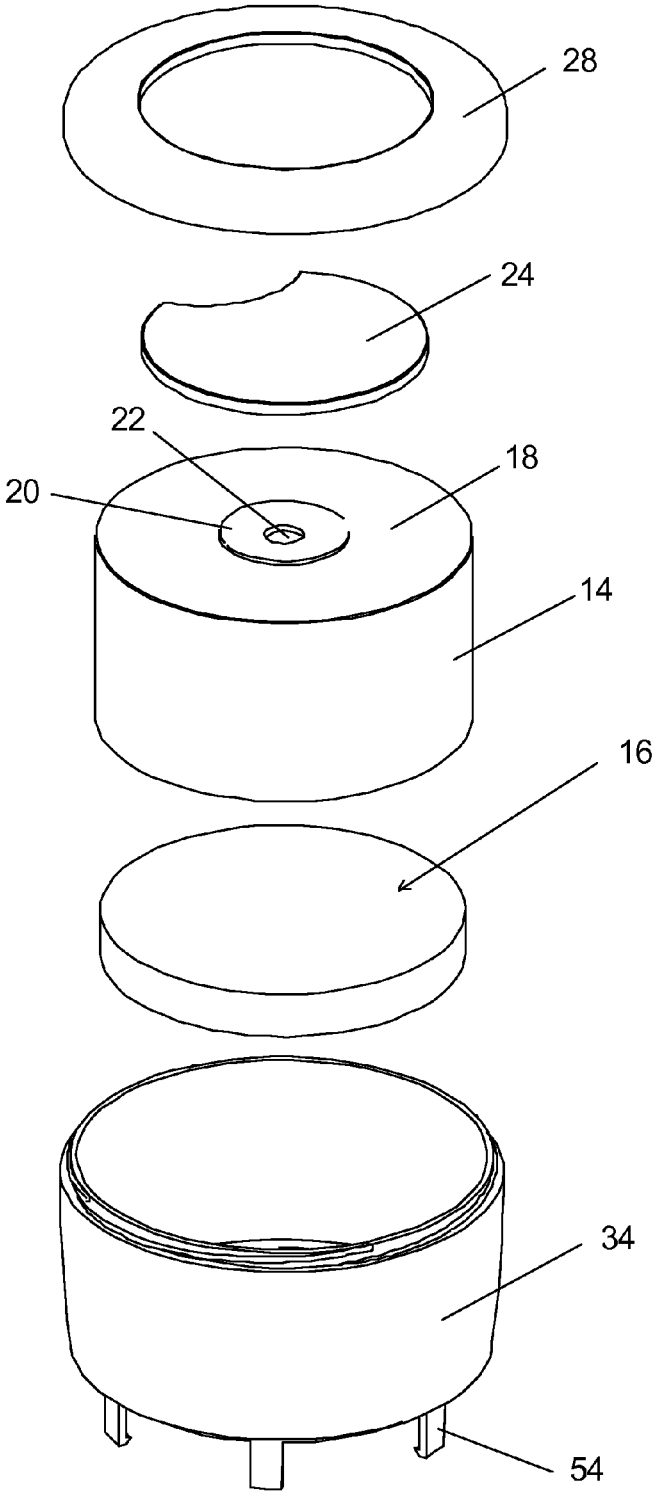
FIG. 3 shows an exploded perspective view of the upper external components of the dispenser of FIG. 1.
Figure 4:
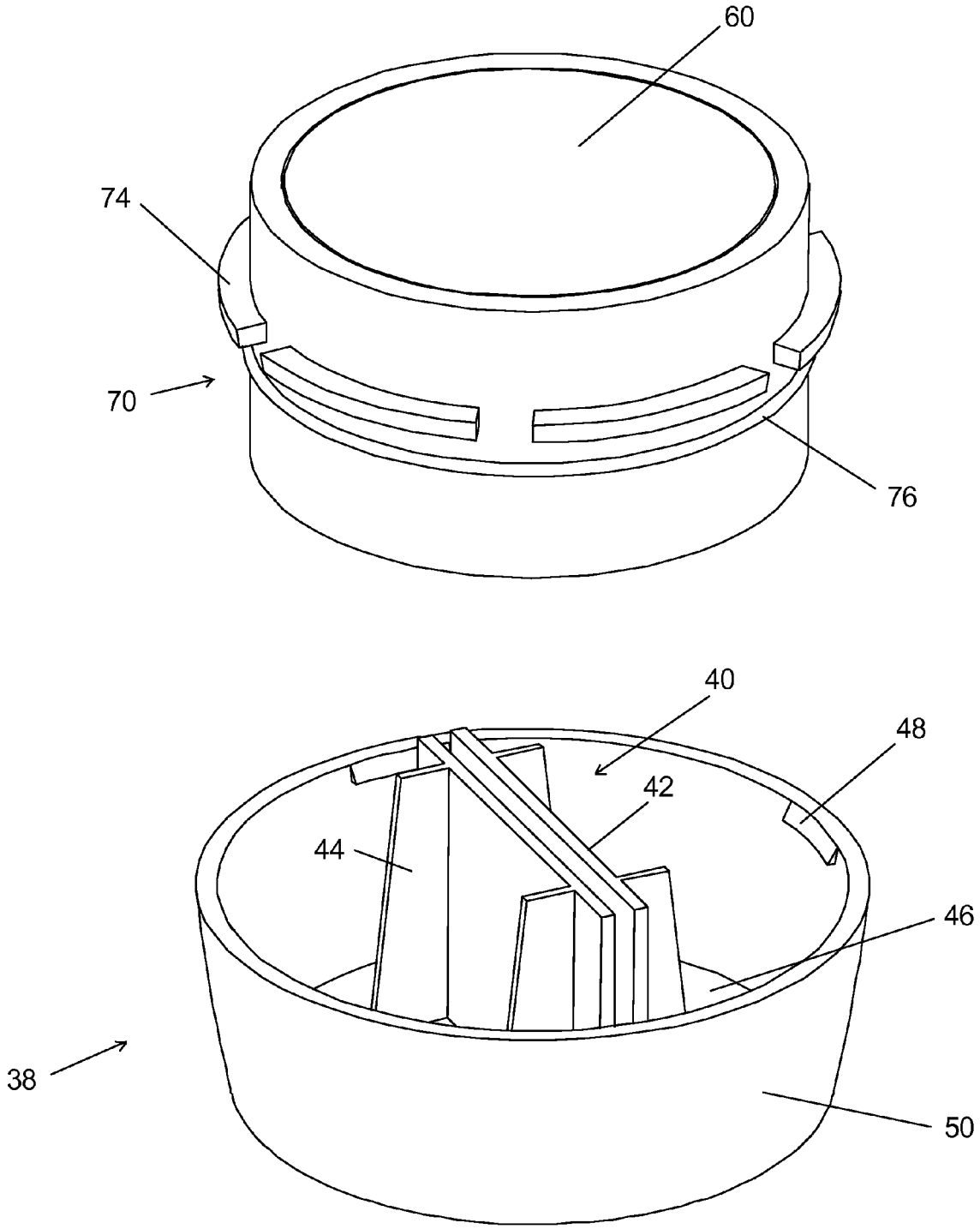
FIGS. 4 and 5 show exploded perspective views of selected internal components of the dispenser of FIG. 1.
Figure 5:
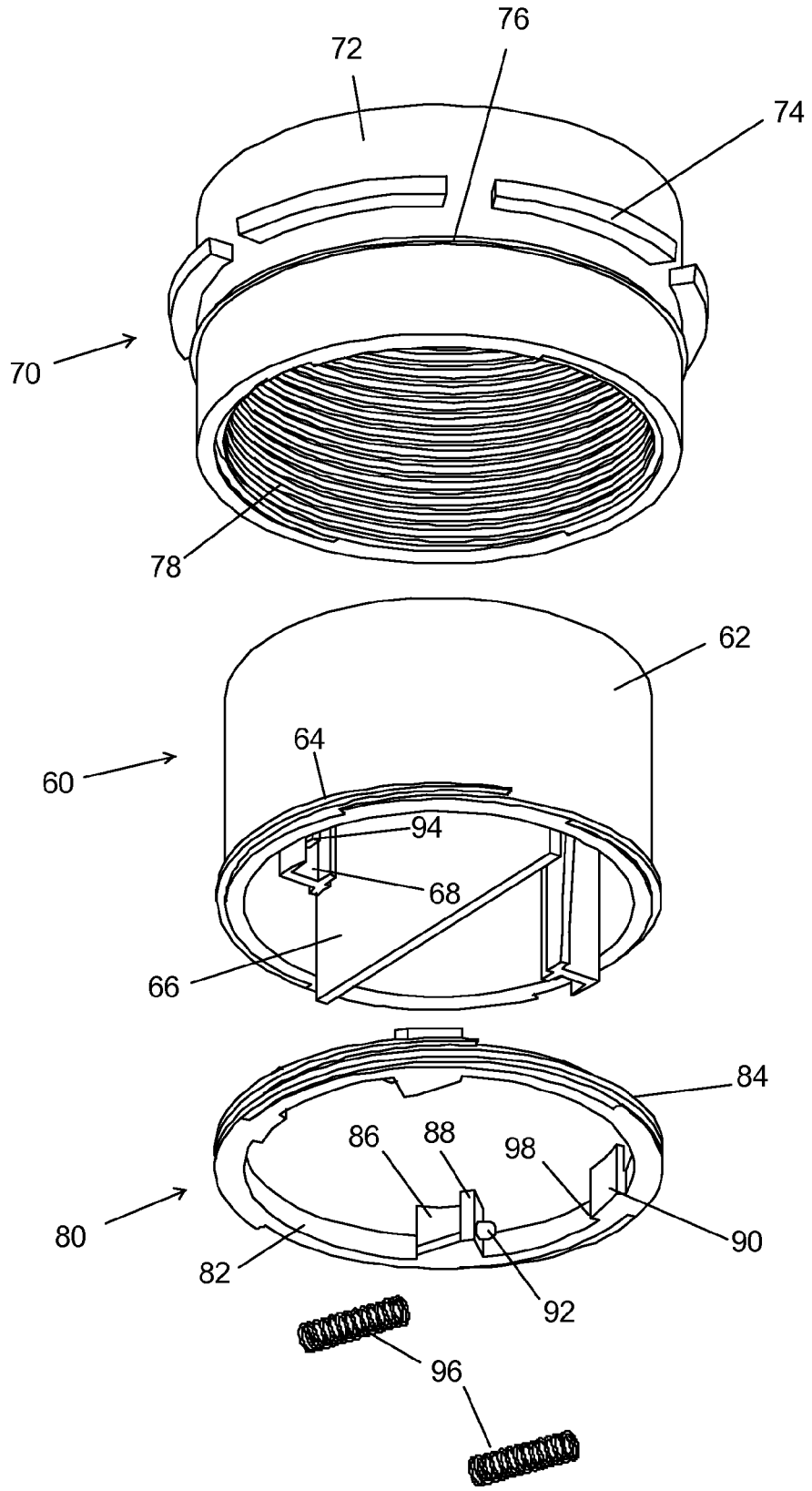
Figure 6:
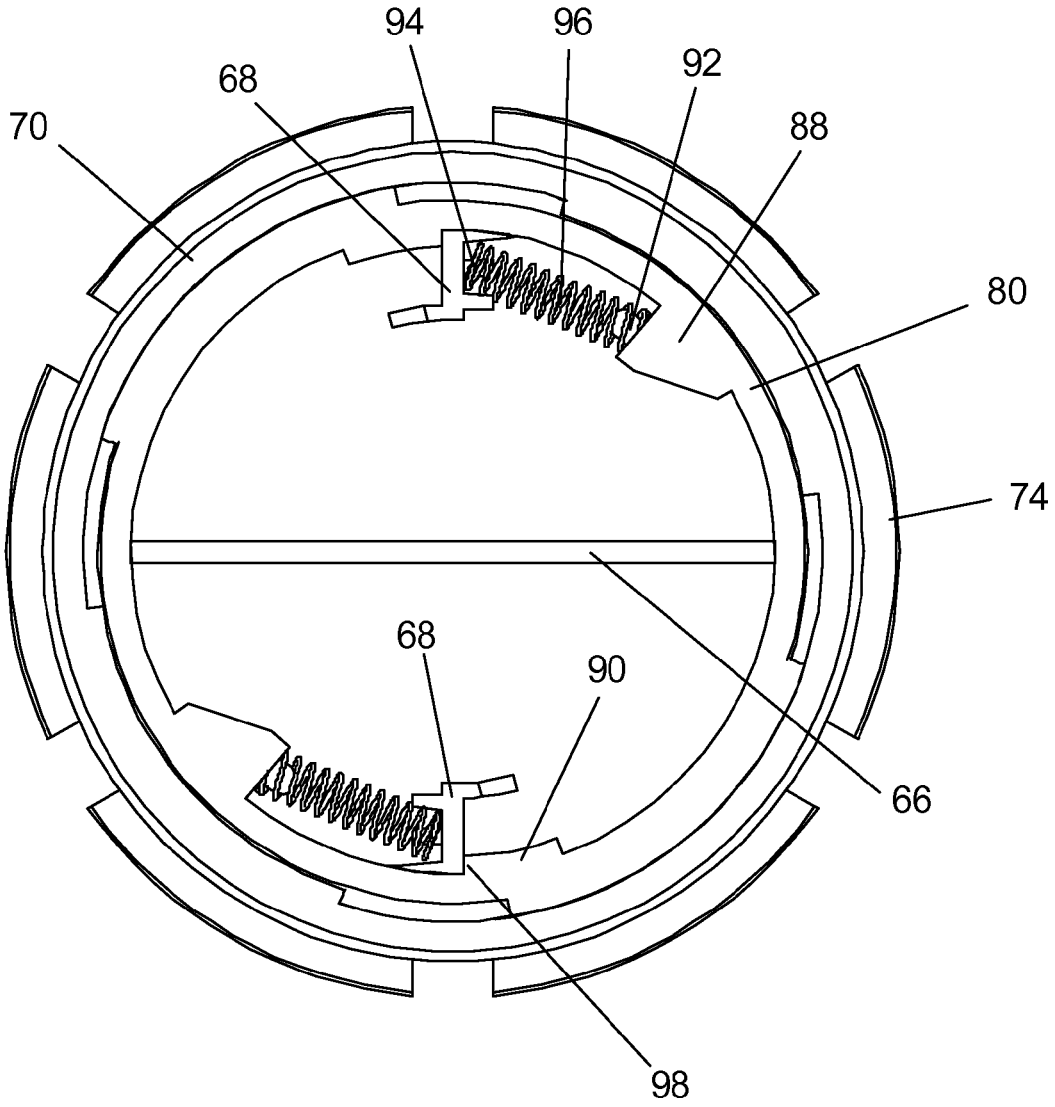
FIG. 6 shows an end view of the dispenser of FIG. 1 with the actuator casing removed.

A preferred embodiment of the invention will now be described by reference to FIGS. 1-6. FIG. 1 is a sectioned view of the dispenser (10) with a fully charged disposable cartridge (12) containing a cosmetic cream (F) or similar viscous fluid; for example the cartridge (12) may contain a medicament cream. The disposable cartridge (12) comprises a cylindrical vessel with a tubular side wall (14); a displaceable piston base (16) and a roof portion (18) having a fluid dispensing recess (20) with a central hole (22) (see FIG. 3). The disposable cartridge (12) is housed above the main dispensing mechanism (52) and within the generally tubular shaped upper side wall (34) and a lid (see FIG. 3). The lid comprises a circular or crescent shaped inner portion (24) with a stopper (26) that seals the central hole (22) of the recess (20); this inner portion (24) engages a surrounding annular portion (28) that has an inner ring-shaped lip (30) that engages the top of the disposable cartridge (12) and an inner female thread (32) that engages a male thread (36) around the top of the side wall (34).

The side wall (34) has a plurality of protrusions (54) (see FIG. 3) located on the bottom of the side wall (34) and these protrusions fit over (see below) a thin flange (76) located around the outside of the main internal tube body (70); thus allowing the attachment of the side wall (34) to the main internal tube body (70).

The lower outer portion of the dispenser (38) (see FIG. 4) has a split vane (40) comprising two parallel spaced apart vertical sheets (42) and four adjacent strengthening members (44) integrally formed with the sheets (42) and inner floor (46) of the lower outer portion (38). The lower outer portion (38) can be rotated about the axis A-A' (see FIG. 1) owing to a plurality of tongues (48) located on the top and inside of the side wall (50) of the outer portion (38) such that these tongues fit over (see below) side protrusions (74) of the main internal body tube (70). Thus, a user may twist the lower outer portion (38) part of a turn in order to activate the dispenser.

Split vane (40) engages (see FIG. 5) a diametric plate (66) that forms an integral part of the main thread member (60). Main thread member (60) comprises a tubular portion (62) with a first outer male thread (64) located at the lower end of the tube (62). The main thread member (60) has two abutment members (68) each with a protrusion (94) located diametrically to each other on the inside surface of the tubular portion (62).

The first thread (64) of the main thread member (60) screws inside the main internal body tube (70). The main internal body tube (70) has an internal female thread (78) that corresponds to the first thread (64) on the main thread member (60). Hence, as the main thread member (60) is turned by abutment against the split vane (40) during turning the lower portion (38) of the dispenser; the main thread member (60) advances along the axis A-A' of the main internal body tube (70) until it abuts against and pushes the displaceable piston base (16) upwardly, so displacing fluid (F) contained in the disposable cartridge (12) through the central hole (22) of the recess (20).

The dispenser has means to partly reverse the direction in which the main thread member (60) was turned inside the main internal body tube (70) during use. This comes into effect when the user stops turning the lower portion (38) and results in main thread member (60) retracting very slightly allowing the displaceable piston (16) to do likewise and thereby reducing the pressure of fluid (F) in the disposable cartridge (12). This is advantageous, as it prevents discharge of fluid after the user has stopped turning the lower portion (38) and so avoids waste. This is particularly important when costly creams (for example certain cosmetics) are being dispensed.

The reverse means may be obtained by the addition of a second thread member (80) and resilient members (96). The second thread member comprises a short tube section (82) with a second male thread (84). Thread 84 has a slightly greater diameter than the first male thread (64). Thus, while the first male thread (64) of the main thread member may be readily screwed inside main internal tube body (70) the second male thread (84) requires the application of considerably more torque to do so. Two further abutment members (88) each with a protrusion (92) are located on the inner cylindrical surface of the second thread member (80). The second thread member also has a plurality of guide members (90) that comprise arcuate walls formed integrally with the second thread member (80). The guide members (84) allow the second thread member (80) to be placed inside the bottom end of the main thread member (60) such that the first and second male threads (64 and 84) form substantially a single continuous thread that allows the members (60, 80) to advance together along axis A-A' as the main thread member (60) is turned within the main internal tube body (70). Two springs (96) are placed between protrusions 92 and 94 and therefore apply a bias between abutment members 68 and 88 (see FIG. 6).

Thus, when a user initially turns the main thread member (60) (by means of the lower main portion 38) the springs (96) initially compress until sufficient torque is thus applied to turn the second thread member (80) also. When the user stops turning the main thread member (60) the springs (94) expand to their at rest length. During this step the tighter fit of the second thread member (80) ensures that the main thread member (60) turns slightly in a backward direction and so eases the pressure applied to the fluid (F) inside the disposable cartridge (12) In use, extension of the spring (96) (to their rest length) is limited by of the edge (98) of the guide members (90) abutting against an edge of the protruding abutment member (68) of the main thread member (see FIG. 6). This prevents the springs (96) disengaging the protrusions (92, 94) when in the rest position.

While the dispenser (10) preferably is used with replaceable disposable cartridges (12) they are not essential. Thus, if the inner wall of the side wall (34) were cylindrically shaped and the piston (16) was a tight fit within the side wall (34) then the cartridge members 14, 18, 20 and 22 could be omitted.

In the above described preferred embodiment the slight increase in the distance between the outer portion (28) and the piston member (60) is provided by finally slightly retracting the piston member (28). In the two further embodiments described below this slight increase in distance is provided by moving the outer portion (28) slightly upwardly again by using threads or the equivalent combined with resilient members (196, 296).

Figure 7:
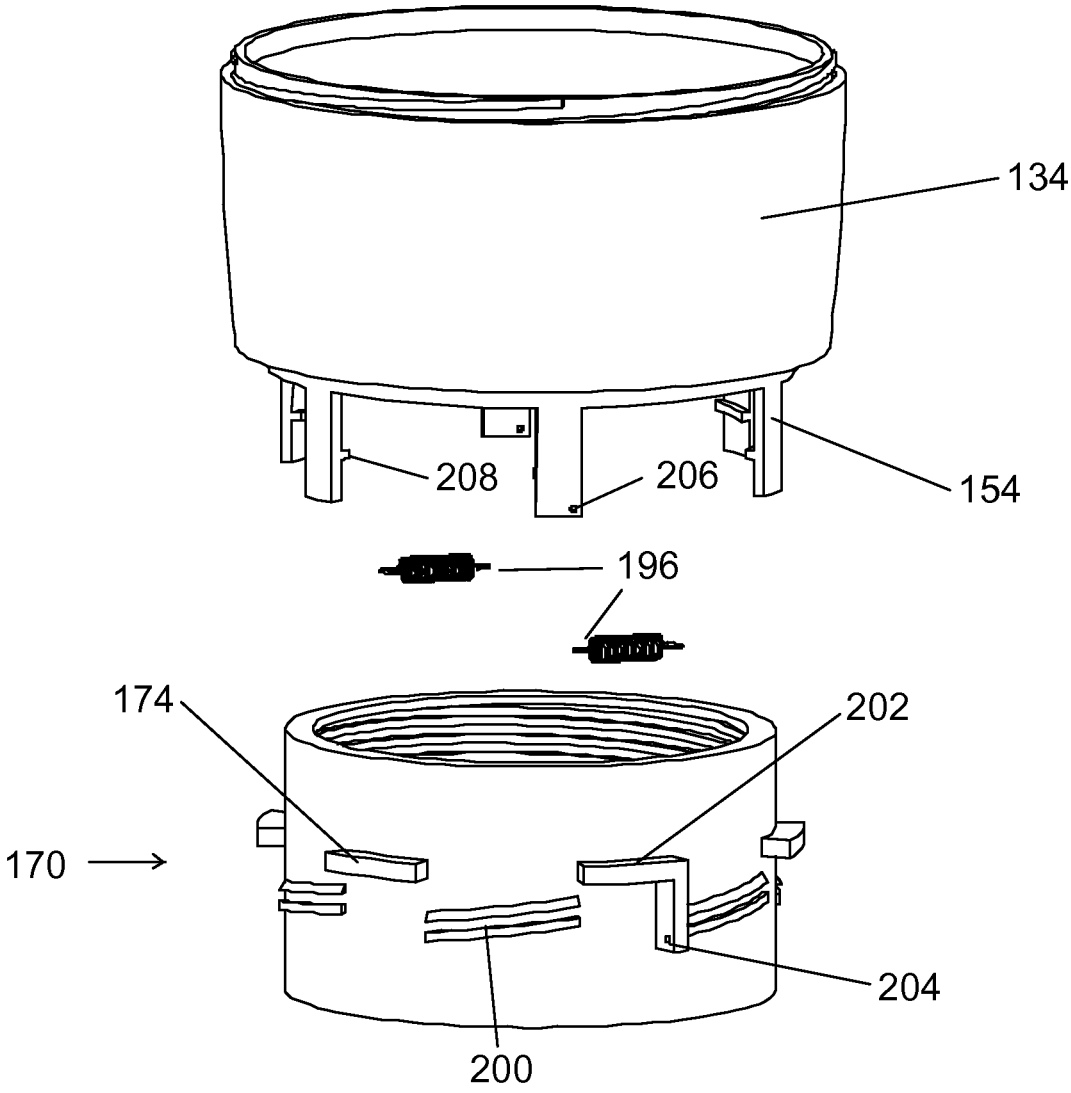
FIG. 7 shows an exploded perspective view of selected components for a second embodiment of the invention.

FIG. 7 shows the main body member (170) and the tubular side wall (134) and their associated components. All the other parts of the dispenser are as described above. The main body member (170) has a plurality of guide tracks (200) each of which slope slightly. Two "L-shaped" members (202) are integrally formed and diametrically positioned on the outer surface of the main body member (170). The tubular side wall (134) has at the bottom end a plurality of protrusions (154) each with a guide member (208) that in use is located within a guide track (200). Resilient members (196) are attached to small holes (204) and (206) located in the "L-shaped" member (202) and selected (diametrically opposed) protrusions (154) respectively.

In use during dispensing, the tubular side wall (134) initially turns clockwise relative to the main body member (170) (as viewed from above) and the resilient members (196) are thereby stretched. The "L-shaped" members (202) integrally formed on the outer surface of the main body member (170) limit the distance that the resilient members (196) are so stretched. Upon completion of turning by the user the resilient members (196) contract to their rest length and so the tubular side wall (134) now turns slightly in an anti-clockwise direction (as viewed from above) relative to the main body member (170); as the guide members (208) are located within the guide tracks (200) that slope this results in these guide members (208) moving up the tracks (200) and thus increases the distance between the main body member (170) and the top end of the side wall (134). This movement thereby causes the desired slight increase in distance between the piston member (60) and the upper outer portion (28) (not shown in FIG. 7).

Figure 8:
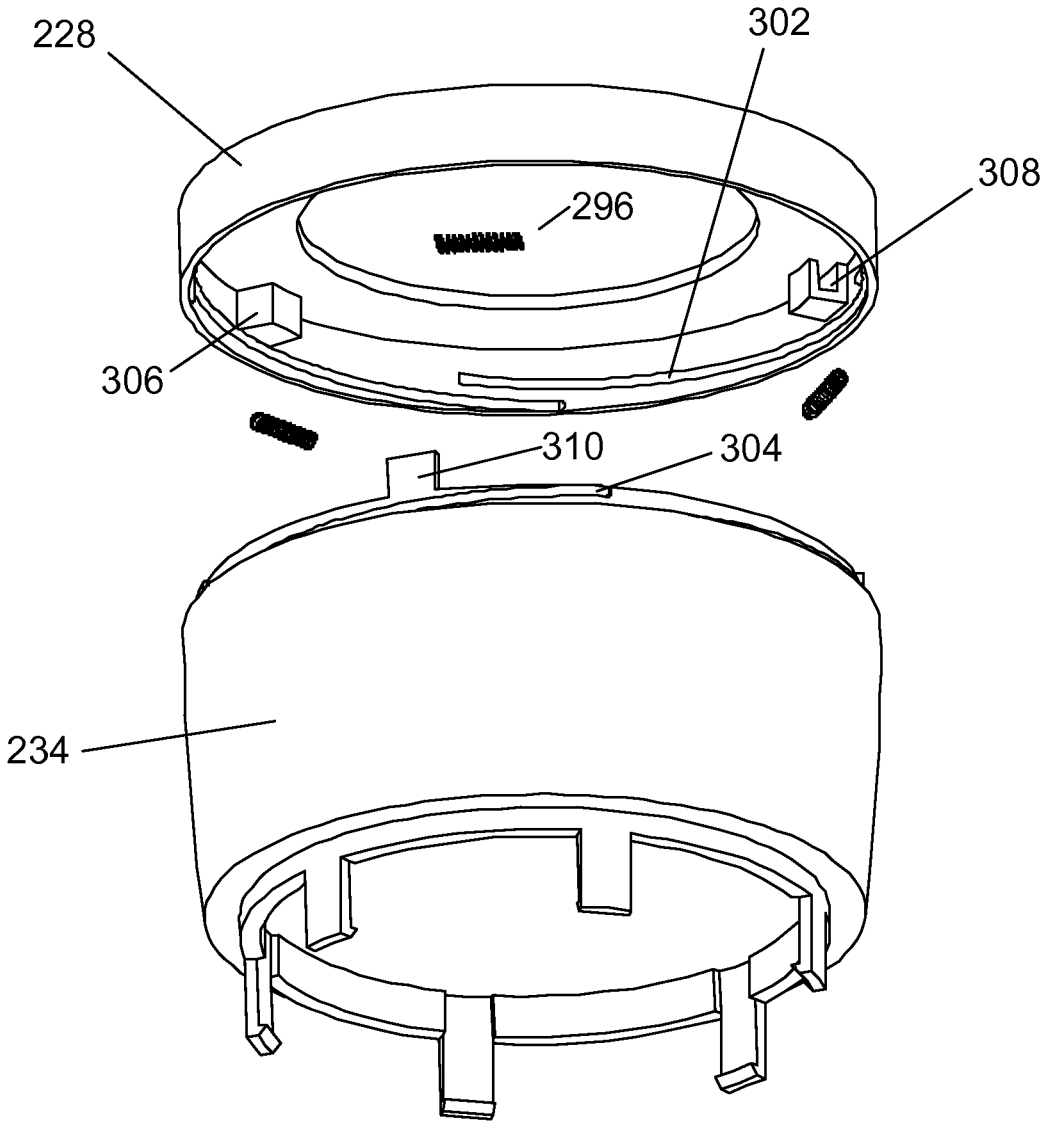
FIG. 8 shows an exploded perspective view of selected components for a third embodiment of the invention.

FIG. 8 shows the upper outer portion (228) and the tubular side wall (234) and their associated components. All the other parts of the dispenser are as described above. The upper outer portion (228) has an inner female thread (302) that engages a corresponding male thread (304) located at the top end of the tubular side wall (234). Abutment members (306, 310) are located on the inner rim of the upper outer portion (228) and the top end of the tubular side wall (234)—just above the male thread (304) respectively. Resilient means (296) abut against a recess (308) in abutment members 306 and a face of abutment members 310. A user dispenses fluid (F) by holding the lower portion of the dispenser (38) and turning the upper outer portion (228)—this action compresses the resilient members (296) and then results in the tubular side wall turning also. On completion of the turning action by the user, the resilient members (296) expand to their rest length and so rotate the upper outer portion (228) relative to the tubular side wall; resulting in the upper outer portion (228) being unscrewed slightly and thus providing the desired increase in distance between the outer portion (28) and the piston member (60), in order to prevent unwanted dispensing of fluid (F).

Preferably, the components of the dispenser are made of suitable plastics materials to assist assembly of the threaded parts etc.—this may include a mixture of rigid and flexible plastics.

The invention claimed is:

1. A dispenser for dispensing a viscous fluid stored directly within a body of the dispenser or within a cartridge inserted within the dispenser, the dispenser comprising:

an upper outer portion including a dispensing aperture in which the viscous fluid is forced through the dispensing aperture by advancing a piston member towards the upper outer portion and where the piston is advanced by turning a first thread member that is located in a female thread of a main body member and where upon completion of such turning resilient means are provided to slightly increase the distance between the outer portion and the piston member, in order to prevent unwanted dispensing of fluid;

wherein the resilient means comprises a spring or other resilient member that is either stretched or compressed during turning of the first thread member and which upon completion of such turning by a user returns to its normal length and thereby exerts a force that provides said slight increase in the distance between the outer portion and the piston member; and wherein the resilient means further comprises a second thread member with a male thread that is also located in the female thread of the main body member and wherein the spring or other resilient member provides bias between the first thread member and the second thread member.

2. A dispenser for dispensing a viscous fluid stored directly within a body of the dispenser, or within a cartridge inserted within the dispenser, the dispenser comprising:

a dispensing aperture in which the viscous fluid is forced through the dispensing aperture by advancing a piston member and where the piston is advanced by turning a first thread member that is located in a female thread of a main body member and where upon completion of such turning resilient means are provided to partly reverse the direction in which the first thread member was turned, in order to prevent unwanted dispensing of fluid;

wherein the resilient means comprises a spring or other resilient member that is either stretched or compressed during turning of the first thread member and which upon completion of such turning by a user returns to its normal length and thereby exerts a force that provides said part reversal in the direction in which the first thread member was turned; and wherein the resilient means further comprises a second thread member with a male thread that is also located in the female thread of the main body member and wherein the spring or other resilient member provides bias between the first thread member and the second thread member.

3. A dispenser according to claim 2 wherein the first thread member is a male thread on the outside of the piston member.

4. A dispenser according to claim 2 wherein in use the second thread member is prevented from reverse turning under the influence of the resilient member because the male thread of the second thread member is a sufficiently tight fit within the main body member.

5. A dispenser according to claim 2 wherein the first thread member or piston has an abutment member with locating means and the second thread member has a similar abutment member and locating means and wherein ends of the spring engage said locating means.

6. A dispenser according to claim 2 wherein the first thread member is turned by a knob directly or indirectly coupled thereto.

7. A dispenser according to claim 6 wherein the knob comprises a lower portion of the dispenser.

8. A dispenser according to claim 7 wherein the lower portion of the dispenser is coupled to the piston by means of a split vane attached to the lower portion of the dispenser.

9. A dispenser according to claim 7 wherein the lower portion of the dispenser is coupled to the piston by means of a member attached to the piston that is held within a member or members attached to the lower portion of the dispenser.

10. A dispenser according to claim 1 wherein the first thread member is a male thread on the outside of the piston member.

11. A dispenser according to claim 1 wherein the first thread member or piston has an abutment member with locating means and the second thread member has a similar abutment member and locating means and wherein ends of the spring engage said locating means.

12. A dispenser according to claim 1 wherein the first thread member is turned by a knob directly or indirectly coupled thereto.

13. A dispenser according to claim 1 wherein in use the second thread member is prevented from reverse turning under the influence of the resilient member because the male thread of the second thread member is a sufficiently tight fit within the main body member.

14. A dispenser according to claim 12 wherein the knob comprises a lower portion of the dispenser.

15. A dispenser according to claim 14 wherein the lower portion of the dispenser is coupled to the piston by means of a split vane attached to the lower portion of the dispenser.

16. A dispenser according to claim 14 wherein the lower portion of the dispenser is coupled to the piston by means of a member attached to the piston that is held within a member or members attached to the lower portion of the dispenser.

* * * * *